United States Patent [19]

Banyash

[11] 4,262,682

[45] Apr. 21, 1981

[54] COMBINATION CIGARETTE HOLDER AND LIGHTER

[76] Inventor: Douglas C. Banyash, 6691 Teal Rd., Petersburg, Mich. 49270

[21] Appl. No.: 76,774

[22] Filed: Sep. 18, 1979

[51] Int. Cl.[3] ..... A24F 47/00

[52] U.S. Cl. ..... 131/185; 131/259

[58] Field of Search ..... 131/185, 257, 258, 259; 431/253

[56] References Cited

U.S. PATENT DOCUMENTS

| | | | |
|---|---|---|---|
| 1,372,304 | 3/1921 | McHesney | 131/259 |
| 1,859,881 | 5/1932 | Nankivell | 431/253 X |
| 2,499,752 | 3/1950 | Hrabal | 431/253 X |
| 2,585,071 | 2/1952 | Allen | 431/253 X |
| 2,818,715 | 1/1958 | Polack | 131/185 |
| 3,071,141 | 1/1963 | McIlwain | 131/259 |

*Primary Examiner*—Stephen C. Pellegrino
*Attorney, Agent, or Firm*—Gifford, VanOphem, Sheridan & Sprinkle

[57] ABSTRACT

A novel cigarette holder is provided in combination with a lighter having a housing and which, upon activation, produces a flame at a predetermined position. The cigarette holder device is directly mounted to the cigarette lighter housing internally or externally and includes a removable holding member movable between a cigarette holding position and a releasing position. In its holding position, the holding member maintains one end of a cigarette at the predetermined flame position.

4 Claims, 5 Drawing Figures

COMBINATION CIGARETTE HOLDER AND LIGHTER

Background of the Invention

I. Field of the Invention

The present invention relates generally to cigarette holders and, more particularly, to a combination cigarette holder and lighter.

II. Description of the Prior Art

There are, of course, a number of previously known cigarette holders. These prior cigarette holders, however, serve merely to hold the cigarette at a position spaced from the user's mouth and to communicate the smoke from the combustion of the cigarette to the user.

Likewise, there have been a number of previously known cigarette cases designed to hold both cigarettes and a cigarette lighter. These prior devices are merely devices of convenience and insure that a cigarette lighter will always be handy when smoking the cigarettes if desired. In all of the respects, however, the cigarette lighter operates independly of and is separable from the cigarette case.

It is very difficult, if not altogether impossible, to smoke the last portion of a cigarette without the user burning his or her fingers. As a result, the last portion or butt of the cigarette is oftentimes simply discarded. This, however, is quite wasteful particularly considering the high cost of tobacco and other smokable substances. Moreover, these previously known cigarette holders have not proven entirely adequate in solving this problem since the cigarette holder is separated from the lighter. Consequently, when attempting to smoke the last portion or butt of the cigarette, while the butt is held in a cigarette holder, the end of the cigarette holder is oftentimes inadvertently brought into contact with the flames from the cigarette lighter, becomes damaged and may even ignite. Moreover, since a portion of the cigarette butt is typically received within a bore or recess at the end of the cigarette holder, the intense heat from the cigarette alone while smoking the butt oftentimes damages the cigarette holder.

SUMMARY OF THE PRESENT INVENTION

The present invention overcomes the above mentioned disadvantages of the previously known devices by providing a combination cigarette lighter and cigarette holder in which the holder is mounted to the lighter and is adapted to maintain one end of a cigarette over the flame from the lighter.

In brief, the lighter is of more or less conventional construction and includes a housing with actuating means to ignite lighter. Upon actuation of the lighter, the flame from the lighter is produced at a predetermined portion or location. Moreover, in the preferred form of the invention, the lighter is a butane lighter with a sealed fuel supply and which is simply discarded after exhaustion of the fuel supply.

The cigarette holding means is mounted directly to the lighter housing and is adapted to hold one end of the cigarette directly over the flame from the lighter. In the preferred form of the invention, the holding means further comprises a V-shaped holding member positioned through a slot in a retainer which is in turn secured to the lighter housing. The retainer slot is dimensioned so that by moving the holding member to an extended position, the free ends of the holding member are spaced apart from each other. Conversely, by moving the holding member to a retracted position, the free ends of the holding member move together and frictionally engage the outer periphery of the cigarette to maintain one end of the cigarette over the flame from the lighter.

BRIEF DESCRIPTION OF THE DRAWING

A better understanding of the present invention will be had upon reference to the following detailed description, when read in conjunction with the accompanying drawing, wherein like reference charactors refer to like parts throughout the several views, and in which.

DETAILED DESCRIPTION OF THE PRESENT INVENTION

Figure 1:
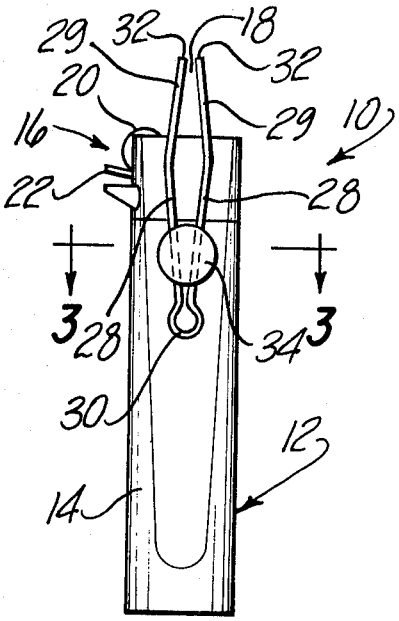
FIG. 1 is a front view showing the device of the present invention.

With reference first to FIG. 1, the combination cigarette lighter and holder 10 according to the present invention is thereshown and comprises a lighter 12 having a housing 14 and lighter actuating means 16 for igniting and producing a flame at position 18 at the top of the lighter housing 14. The lighter 12 is illustrated in the drawing as a so-called "disposable" lighter which burns butane but in which the butane fuel supply is sealed within the housing 14. Consequently, upon exhaustion of the butane supply, the entire lighter 12 is usually discarded. Moreover, in this type of lighter the flame ignition means 16 conventionally includes a flint wheel 20 and a valve actuator 22. As is well known, in order to light the lighter, the flint wheel 20 is spun by the user to produce a spark while the valve actuator 22 is depressed in order to release the butane fuel. It will be understood, however, that other types of lighters 12 can be employed without deviation from either the spirit or scope of the invention.

Figure 2:
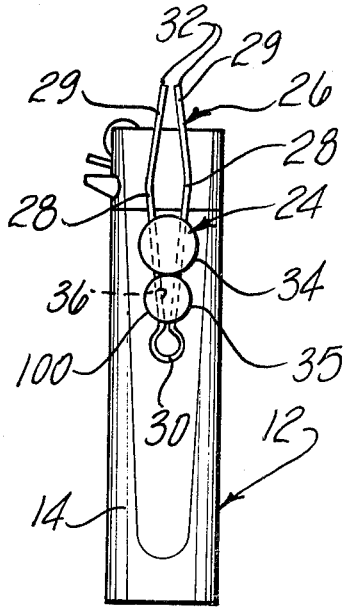
FIG. 2 is a front view similar to FIG. 1 but showing the device in a different operable position.
Figure 3:
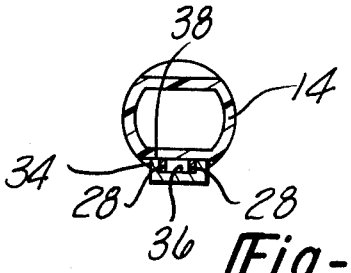
FIG. 3 is a fragmentary sectional view taken along line 3–3 in FIG. 1.

With reference to FIGS 1–3, a cigarette holding means 24 is attached directly to the housing 14 of the cigarette lighter 12 in a fashion which will be subsequently subscribed in greater detail. The cigarette holding means 24 is of simple construction and includes a substantially V-shaped member 26 having a pair of arms 28 secured together at one end 30. The opposite or free ends 32 of the arms 28 are angled towards each other by the portions 29 but are otherwise unconnected. The V-shaped member 26 is preferably integrally constructed from a resilient, fire resistant material, such as brass or other metal alloy.

The cigarette holding means 24 further includes a retainer housing 34 having an elongated through slot 36 of a rectangular cross-sectional shape formed along one side 38 of the retainer housing 34. The width of the slot 36 is less than the width of the holding member 26 along the portions 29. The side 38 of the retainer housing 34 is secured to the lighter housing 14 near the top of the lighter 12 by gluing or other appropriate means.

The V-shaped holding member 26 is slidably inserted or removed through the slot 36 so that the free ends 32 of the arms 28 are positioned adjacent the lighter flame position 18. Moreover, the holding member 26 is movable between an extended position illustrated in FIG. 1 and a retracted position illustrated in FIG. 2. In the extended position of the holding member 26, the free ends 32 of the arms 28 are spaced apart from each other. Conversely, as the holding member 26 is moved to its retracted position, the side walls of the retainer housing slot 36 engage the arms 28 and move the arms 28, and thus their free ends 32 together until the free ends 32 of the arms 28 abut against each other. Due to the resiliency of the holding member 26, however, upon shifting the holding member 26 back to its extended position, the arms 28 again flare outwardly and their free ends 32 separate from each other as shown in FIG. 1.

Figure 4:
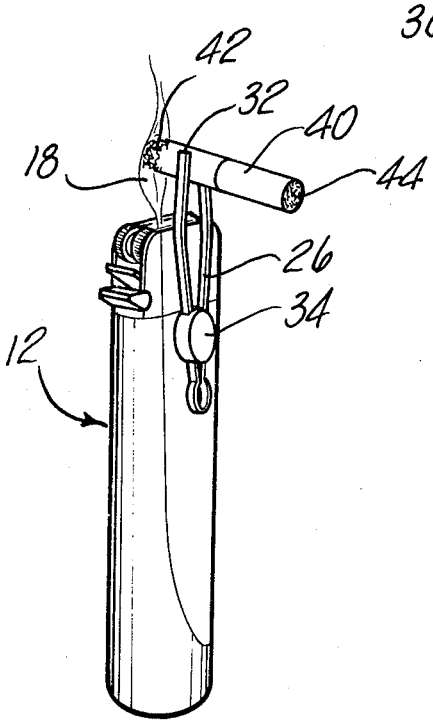
FIG. 4 is a perspective view illustrating the operation of the present invention.

With reference now to FIG. 4, in operation the holding member 26 is first moved to its extended position and so that the free end 32 of the arm 28 are spaced apart from each other. An elongated cigarette 40 is then positioned between the free ends 32 of the arms 28 while the holding member 26 is moved to its retracted position. In doing so, the free ends 32 of the arms 28 move toward and frictionally engage the outer periphery of the cigarette 40 and maintain as end 42 of the cigarette at the flame position 18 for lighter 12.

Thereafter, upon activation of the flame ignition means 16 in the previously described fashion, the flame from the lighter ignites the end 42 of the cigarette 40 while the user can inhale smoke through the opposite end 44 of the cigarette 40. In the event that the cigarette 40 becomes extinguished, it can be easily and rapidly be relit by simply relighting the lighter 12 as required. When the cigarette 40 has been fully smoked, the holding member 26 is moved to its extended position thus releasing the remaining butt portion of the cigarette 40.

Referring now to FIG. 2, in a modified form of the invention a further retainer housing 100 having a closed throughbore is also positioned around the V-shaped member 26 adjacent to but downwardly from the first retainer housing 34. The second housing 100 serves as a thumb piece to facilitate the extension and retraction of the V-shaped member 26 through the first housing 34. In addition, both the V-shaped member 26 and the second retainer housing 100 can be removed from the first retainer housing and used independently as a cigarette holder.

Figure 5:
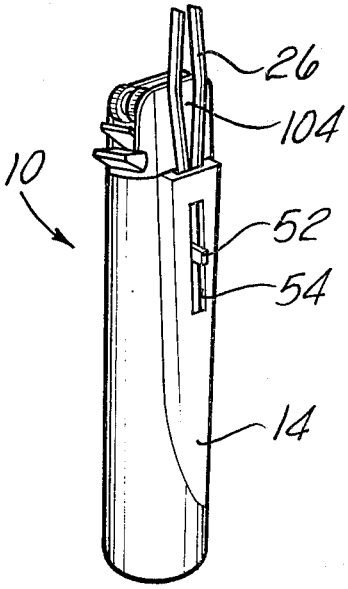
FIG. 5 is a perspective view illustrating a modification of the present invention.

Referring now to FIG. 5, it will also be understood that the retainer housing 34 can be stamped from the flame guard 104.

It will also be understood that as the cigarette end 42 burns down somewhat, the cigarette holding means can be readjusted to reposition the unburned portion of the cigarette end 42 in the flame.

With reference now to FIG. 5, a modification of the invention is thereshown in which the V-shaped holding member 26 is recessed within a slot 50 formed within the lighter housing 14. An activating button 52 is secured to the holding member 26 and extends outwardly through an elongated slot 54 in the housing 14 to enable actuation of the holding member 26.

Form the foregoing it can be seen that the combination cigarette lighter and holder 10 according to the present invention provides a novel means by which very short portions or butts of cigarettes can be fully consumed or smoked. Moreover, in the event that the cigarette becomes extinguished, it can be easily relighted by simply relighting the lighter 12.

Having described my invention, however, many modifications thereto will become apparent to those skilled in the art to which it pertains without deviation from the spirit of the invention as defined by the scope of the appended claims.

I claim:

1. A smoking device comprising:

a cigarette lighter having a housing, said housing having a flat side, and means for activating said cigarette lighter to produce a flame at a predetermined position; and means secured to said flat side of said lighter housing for detachably holding an elongated cigarette to said lighter housing so that one end of the cigarette is maintained substantially at said predetermined position, said holding means comprising a one-piece cigarette holding member constructed of a resilient material and having a pair of elongated arms, each arm having a free end which is positioned adjacent the free end of the other arm, and means for slidably mounting said holding member to said lighter housing between an extended and a retracted position wherein said extended position and the free ends of the arms are spaced apart from each other, and means for moving the free ends of the arms toward each other to engage the outer periphery of the cigarettes upon moving said holding member from its extended and to its retracted position and wherein said slidable mounting means further comprises a retainer attached to said lighter housing, said retainer having a channel formed along one side, said one sideof said retainer being attached to said flat side of said housing with a portion of said elongated arms within said channel so that said arms are entrapped between said retainer channel and said flat side of said lighter housing and so that said holding member is flush against the flat side of the lighter housing.

2. The invention as defined in claim 1 wherein each arm includes a portion adjacent its free end which is inclined toward the portion on the other arm.

3. The invention as defined in claim 1 wherein the width of the holding member is greater than the width of the retainer slot along at least a position of the holding member.

4. The invention as defined in claim 1 wherein said lighter is a disposable butane lighter.

* * * * *

UNITED STATES PATENT AND TRADEMARK OFFICE

CERTIFICATE OF CORRECTION

PATENT NO. : 4,262,682

DATED : April 21, 1981

INVENTOR(S) : Douglas C. Banyash

It is certified that error appears in the above-identified patent and that said Letters Patent are hereby corrected as shown below:

Column 1, line 22, delete "independly" and insert --independently-- therefor;

Column 4, line 41, delete "sideof" and insert --side of-- therefor;

Column 4, line 53, delete "position" and insert --portion-- therefor.

Signed and Sealed this

*Thirtieth* Day of *June 1981*

[SEAL]

*Attest:*

RENE D. TEGTMEYER

*Attesting Officer*

*Acting Commissioner of Patents and Trademarks*